US012448690B2

(12) United States Patent
Hatabe et al.

(10) Patent No.: US 12,448,690 B2
(45) Date of Patent: Oct. 21, 2025

(54) TREATMENT METHOD AFTER PLATING WITH SN OR SN ALLOY

(71) Applicant: ISHIHARA CHEMICAL CO., LTD., Kobe (JP)

(72) Inventors: Masaru Hatabe, Kobe (JP); Akihiro Yoshizawa, Kobe (JP); Takahiro Tanaka, Kobe (JP)

(73) Assignee: ISHIHARA CHEMICAL CO., LTD., Kobe (JP)

( * ) Notice: Subject to any disclaimer, the term of this patent is extended or adjusted under 35 U.S.C. 154(b) by 0 days.

(21) Appl. No.: 18/259,231

(22) PCT Filed: Nov. 22, 2021

(86) PCT No.: PCT/JP2021/042711
§ 371 (c)(1),
(2) Date: Jun. 23, 2023

(87) PCT Pub. No.: WO2022/137935
PCT Pub. Date: Jun. 30, 2022

(65) Prior Publication Data

US 2024/0052501 A1 Feb. 15, 2024

(30) Foreign Application Priority Data

Dec. 24, 2020 (JP) ..... 2020-214408

(51) Int. Cl.
*C23G 1/02* (2006.01)
*C25D 5/48* (2006.01)
*C25D 21/08* (2006.01)

(52) U.S. Cl.
CPC ..... *C23G 1/02* (2013.01); *C25D 5/48* (2013.01); *C25D 21/08* (2013.01)

(58) Field of Classification Search
CPC ..... C23G 1/02; C25D 5/48; C25D 21/08
See application file for complete search history.

(56) References Cited

U.S. PATENT DOCUMENTS 3,612,243 A * 10/1971 McAllister ..... B65G 49/0459 198/341.02
3,888,778 A * 6/1975 Beckwith ..... H05K 3/3489 252/79.3
3,915,812 A * 10/1975 Yamagishi ..... C25F 1/00 205/217
4,337,134 A * 6/1982 Norman ..... C25D 17/00 204/278
5,935,330 A 8/1999 Taniguchi
2004/0251143 A1 12/2004 Kazuyuki et al.
2006/0113195 A1* 6/2006 Hradil ..... C25D 3/60 205/302
2007/0042122 A1 2/2007 Orihashi
2017/0342566 A1 11/2017 Shibanuma et al.

FOREIGN PATENT DOCUMENTS

GB 1453886 * 10/1976
JP H05-140793 A 6/1993
JP 3583883 B2 11/2004
JP 2006009051 A 1/2006
JP 2007-056286 A 3/2007
WO WO 2016/103816 A1 6/2016
WO WO 2018/079188 A1 5/2018

OTHER PUBLICATIONS

Machine Translation of JP2003027277A (Year: 2003).*
International Search Report dated Jan. 25, 2022 for Application No. PCT/JP2021/042711 in 2 pages.
Office Action dated Jul. 2, 2025 issued in Taiwanese Patent Application No. TW 110148205, in 11 pages.
Office Action dated Jul. 15, 2025 issued in Japanese Patent Application No. JP 2020-214408, in 8 pages.
Office Action dated Sep. 17, 2025 issued in Taiwanese Patent Application No. TW 110148205, in 13 pages.

* cited by examiner

*Primary Examiner* — Sharidan Carrillo
(74) *Attorney, Agent, or Firm* — Knobbe, Martens, Olson & Bear, LLP

(57) ABSTRACT

A treatment method is for preventing compound contaminations derived from Sn or an Sn alloy, which have precipitated on members, such as a substrate and a conveyance tool, from accumulating after plating with Sn or the Sn alloy. The method includes washing at least one of the members used in a series of plating treatment steps with an acidic solution immediately after the plating with Sn or the Sn alloy. The acidic solution contains at least one acid or salt thereof having a pH of 5 or lower.

7 Claims, No Drawings

TREATMENT METHOD AFTER PLATING WITH SN OR SN ALLOY

PRIORITY AND CROSS REFERENCE TO RELATED APPLICATIONS

This application is the U.S. National Stage Application under 35 U.S.C. § 371 of International Application No. PCT/JP2021/042711, filed Nov. 22, 2021, designating the U.S. and published as WO 2022/137935 A1 on Jun. 30, 2022, which claims the benefit of Japanese Patent Application No. JP 2020-214408, filed Dec. 24, 2020. Any and all applications for which a foreign or a domestic priority is claimed is/are identified in the Application Data Sheet filed herewith and is/are hereby incorporated by reference in their entirety under 37 C.F.R. § 1.57.

TECHNICAL FIELD

The present invention relates to treatment methods after plating with Sn or an Sn alloy. The present invention particularly relates to a treatment method for members, for preventing compound contaminations derived from Sn or an Sn alloy, which have precipitated on the members used in a series of plating treatment steps, from accumulating after plating with Sn or the Sn alloy, and the members used in the series are, for example, a substrate such as a wafer, a printed substrate and a conveyance tool for the substrates.

BACKGROUND ART

In general, a plating liquid and contaminations which adhere to a substrate are washed with water or warm water after plating with various metals and plating with various alloys on the substrate.

After plating with Sn and an Sn alloy, however, compound contaminations derived from Sn and the Sn alloy, which cannot be removed by general washing as mentioned above, accumulate, and plating extension to a plating apparatus and a conveyance tool may occur, or the compound contaminations themselves on the substrate cause a problem. Thus, members used in plating treatment steps have to be frequently replaced, or the contaminations have to be removed by a special washing method. As a result, work efficiency is reduced and also a major cost burden is led.

Therefore, various kinds of methods have been proposed, in which improved plating apparatuses are used and contaminations after plating are removed by washing.

For example, Patent Literature 1 describes an automatic wafer plating apparatus including a load stage, an orientation alignment stage, a plating stage, a recovery stage, and a washing stage. Patent Literature 1 further describes a method in which the plating apparatus is used. In this method, a wafer which is sequentially conveyed from the load stage to the washing stage and is plated in the plating stage during the course of conveyance is washed in the washing stage which is a final stage.

Patent Literature 2 describes a plating apparatus in a face-up system. This plating apparatus includes: a plating bath of which bottom surface has an opening, and a substrate holder which supports a back surface of a substrate to be treated and which is movable to close the opening with the substrate to be treated. Patent Literature 2 further describes a washing method including spraying a washing liquid onto the back surface of the substrate to be treated while the substrate to be treated is moved from the substrate holder supporting the back surface of the substrate to be treated, which has a surface subjected to plating treatment by the plating apparatus.

CITATION LIST

Patent Literature

[Patent Literature 1] Japanese Patent No. 3583883
[Patent Literature 2] Japanese Laid-Open Patent Publication No. 2006-009051

SUMMARY OF INVENTION

Technical Problem

In the method described in Patent Literature 1, it is probable that a general washing liquid, i.e., water or warm water is used in the washing stage which is the final stage. When such washing stage is applied to plating treatment with Sn or an Sn alloy, primary washing alone is insufficient. As a result, precipitated compound contaminations derived from Sn or the Sn alloy accumulate, and there is a possibility that plating extension to a plating apparatus, a conveyance tool and the like occurs in the future. Thus, in order to eliminate such possibility, the conveyance tool and the like have to be frequently replaced, or a special washing method has to be adopted.

In the washing method described in Patent Literature 2, the substrate to be treated itself such as a wafer can be washed. However, washing of the conveyance tool for the substrate to be treated, and the like is insufficient, and therefore, there is a possibility that the plating extension to the conveyance tool and the like occurs in the future. Thus, in order to eliminate such possibility, the conveyance tool and the like still have to be frequently replaced, or a special washing method still has to be adopted.

In view of conventional problems mentioned above, it is an object of the present invention to provide a treatment method for easily and effectively preventing compound contaminations derived from Sn or an Sn alloy, which have precipitated on, in particular, a substrate such as a wafer, a conveyance tool and the like, from accumulating after plating with Sn or the Sn alloy.

Solution to Problem

In order to achieve the above object, the present inventors have intensively studied and consequently found that washing of a substrate, a conveyance tool and the like with a specific acidic solution immediately after plating with Sn or an Sn alloy can easily and effectively prevent precipitated compound contaminations derived from Sn or the Sn alloy from accumulating, and thereby, the present invention has been completed.

Specifically, a treatment method after plating with Sn or an Sn alloy of the present invention includes washing at least one of members used in a series of plating treatment steps with an acidic solution immediately after the plating, and the acidic solution contains at least one kind selected from acids and salts thereof and has a pH of 5 or lower.

In the treatment method of the present invention, immediately after the plating with Sn or the Sn alloy, the members on which compound contaminations derived from Sn or the Sn alloy have precipitated are washed with the acidic solution, and the acidic solution contains the acid and/or the salt of each acid and has a specific pH of 5 or lower. As mentioned later, in the treatment method of the present invention, general washing with water or warm water and drying may be performed after the plating. However, in the treatment method of the present invention, even in the case of performing the washing with water or warm water and the drying, the washing with the acidic solution is performed before the washing with water or warm water and the drying, that is, immediately after the plating. Thus, in the treatment method of the present invention, the washing with the acidic solution is performed subsequently to the plating, and then, the washing with water or warm water and the drying are optionally performed. Therefore, unlike a conventional washing method using merely a general washing liquid such as water or warm water and a conventional washing method directed to only a specific member to be subjected to plating treatment, the treatment method of the present invention can easily and effectively prevent compound contaminations derived from Sn or the Sn alloy, which have precipitated on various members used in a series of plating treatment steps, from accumulating.

In the treatment method of the present invention, when the members are a substrate and a conveyance tool for the substrate, the washing with the acidic solution is preferably performed in a state where the substrate is fixed to the conveyance tool. By performing the washing with the acidic solution in a state where the substrate is fixed to the conveyance tool as mentioned above, the washing of the conveyance tool, which is conventionally labor intensive and/or insufficient, can be easily and satisfactorily performed.

In the treatment method of the present invention, the at least one kind selected from acids and salts thereof contained in the acidic solution preferably comprises at least one kind selected from organic acids and salts thereof. By washing the members with the acidic solution containing the organic acid and/or the salt of each organic acid, the precipitated compound contaminations derived from Sn or the Sn alloy can be more effectively prevented from accumulating.

In the treatment method of the present invention, a content of the at least one kind selected from acids and salts thereof in the acidic solution is preferably 8 g/L to 700 g/L. By washing the members with the acidic solution in which the content of the acid and/or the salt of each acid is adjusted to this range, the precipitated compound contaminations derived from Sn or the Sn alloy can be more effectively prevented from accumulating.

In the treatment method of the present invention, the acidic solution preferably contains at least one kind selected from complexing agents and chelate agents. By washing the members with the acidic solution further containing the complexing agent and/or the chelate agent, the precipitated compound contaminations derived from Sn or the Sn alloy can be more effectively prevented from accumulating.

In the treatment method of the present invention, the acidic solution preferably contains: at least one kind selected from nonionic surfactants; or at least one kind selected from ionic surfactants. By washing the members with the acidic solution further containing the nonionic surfactant or the ionic surfactant, the precipitated compound contaminations derived from Sn or the Sn alloy can be more effectively prevented from accumulating.

Advantageous Effects of Invention

The treatment method of the present invention can easily and effectively prevent the compound contaminations derived from Sn or the Sn alloy, which have precipitated on the members; including a substrate such as a wafer, a printed substrate and a conveyance tool for the substrates; and being used in a series of plating treatment steps, from accumulating after the plating with Sn or the Sn alloy. Thus, in the treatment method of the present invention, it is not necessary to frequently replace the members used in the plating treatment steps and adopt a special washing method for removing the contaminations unlike the conventional methods. Therefore, the treatment method of the present invention can satisfactorily inhibit reduction of work efficiency and increase of cost burden.

DETAILED DESCRIPTION

Embodiments of the present invention will be described in detail below. The description of the following preferable embodiments are substantially mere examples and do not intend to limit the present invention, application methods thereof, or uses thereof.

A treatment method after plating with Sn or an Sn alloy of the present invention includes washing at least one of members used in a series of plating treatment steps with a specific acidic solution immediately after the plating.

The specific acidic solution used in the treatment method of the present invention is a solution containing at least one kind selected from acids and salts thereof, i.e., the acid and/or the salt thereof, and having a pH of 5 or lower. By performing the washing with such specific acidic solution immediately after the plating, there can be realized easy and effective prevention of accumulation of the precipitated compound contaminations derived from Sn or the Sn alloy, which cannot be realized by conventional washing with water or warm water.

The acid contained in the acidic solution is not particularly limited. Examples of the acid include: organic acids such as organic sulfonic acids, e.g., methanesulfonic acid, ethanesulfonic acid, 2-propanolsulfonic acid, sulfosuccinic acid and p-phenolsulfonic acid, and carboxylic acids, e.g., acetic acid, formic acid, oxalic acid, tartaric acid, citric acid and glyoxylic acid, inorganic acids such as sulfuric acid, hydrochloric acid, phosphoric acid, phosphorous acid, hypophosphorous acid, sulfamic acid, and nitric acid; and salts thereof. These acids can be used alone, or two or more kinds of which can be used simultaneously. Among them, from the viewpoint that the precipitated compound contaminations derived from Sn or the Sn alloy can be more effectively prevented from accumulating, the acid and/or the salt thereof contained in the acidic solution is preferably at least one kind selected from the organic acids and the salts thereof, i.e., at least one kind of the organic acid and/or the salt thereof.

The pH of the acidic solution is 5 or lower, and preferably 2 or lower. The acidic solution is more preferably a strongly acidic solution having the pH of 1 or lower. When the pH of the acidic solution is higher than the upper limit, the acidic solution has no difference from water or warm water and the precipitated compound contaminations derived from Sn or the Sn alloy cannot be effectively prevented from accumulating.

A content of the acid and/or the salt thereof in the acidic solution is preferably 8 g/L to 700 g/L, and more preferably 10 g/L to 650 g/L. When the content of the acid and/or the salt thereof is less than the lower limit, there is a possibility that the precipitated compound contaminations derived from Sn or the Sn alloy cannot be effectively prevented from accumulating. When the content of the acid and/or the salt thereof is more than the upper limit, there is a possibility that the acid and/or the salt thereof recrystallizes beyond solubility and thus deposits as new contaminations, and that an acid concentration becomes to be too high and a plated coating film is damaged.

The acidic solution preferably contains at least one kind selected from complexing agents and chelate agents, i.e., at least one kind of the complexing agent and/or the chelate agent. By washing the members with the acidic solution containing the complexing agent and/or the chelate agent together with the acid and/or the salt thereof, the precipitated compound contaminations derived from Sn or the Sn alloy can be more effectively prevented from accumulating.

Examples of the complexing agent include gluconic acid, glycine, citric acid, malic acid, glucoheptonic acid, gluconolactone, glucoheptolactone, succinic acid, malonic acid, tartaric acid, oxalic acid, erythorbic acid, sorbic acid, ascorbic acid, pyrophosphoric acid, and a salt thereof.

Examples of the chelate agent include ethylenediamine, ethylenediaminetetraacetic acid (EDTA), diethylenetriaminepentaacetic acid (DTPA), nitrilotriacetic acid (NTA), iminodiacetic acid (IDA), iminodipropionic acid (IDP), hydroxyethylethylenediaminetriacetic acid (HEDTA), triethylenetetraminehexaacetic acid (TTHA), 1,3-propanediamine-N,N,N',N'-tetraacetic acid (PDTA), 1,3-diamino-2-hydroxypropanol-N,N,N',N'-tetraacetic acid (DPTA), N-(2-hydroxyethyl)iminodiacetic acid (HIDA), N,N-bis(2-hydroxyethyl)glycine (DHEG), glycoletherdiaminetetraacetic acid (GEDTA), ethylenediamine-N,N'-disuccinic acid (EDDS), and a salt thereof.

A content of the complexing agent and/or the chelate agent in the acidic solution is preferably 1 g/L to 30 g/L, and more preferably 2 g/L to 25 g/L. When the content of the complexing agent and/or the chelate agent is less than the lower limit, there is a possibility that effect of preventing the precipitated compound contaminations derived from Sn or the Sn alloy from accumulating cannot be satisfactorily improved. When the content of the complexing agent and/or the chelate agent is more than the upper limit, there is a possibility that the complexing agent and/or the chelate agent recrystallizes beyond solubility and thus deposits as new contaminations.

The acidic solution preferably contains at least one kind selected from nonionic surfactants or at least one kind selected from ionic surfactants, i.e., at least one kind of: the nonionic surfactant; or the ionic surfactant. By washing the members with the acidic solution containing the nonionic surfactant or the ionic surfactant together with the acid and/or the salt thereof, the precipitated compound contaminations derived from Sn or the Sn alloy can be more effectively prevented from accumulating.

Examples of the nonionic surfactant include surfactants obtained by an addition condensation reaction of: C1 to C20 alkanols, phenols, naphthols, bisphenols, C1 to C25 alkyl phenols, arylalkyl phenols, C1 to C25 alkyl naphthols, C1 to C25 alkoxyl phosphoric acids (salts), sorbitan esters, polyalkylene glycols, C1 to C22 aliphatic amides, and the like; with ethylene oxide (EO) and/or propylene oxide (PO).

Examples of the ionic surfactant include: anionic surfactants such as alkyl sulfates, polyoxyethylene alkylether sulfates, polyoxyethylene alkylphenylether sulfates, alkylbenzene sulfonates, and alkylnaphthalene sulfonates; and cationic surfactants such as mono- to tri-alkylamine salts, dimethyldialkylammonium salts, and trimethylalkylammonium salts.

A content of the nonionic surfactant or the ionic surfactant in the acidic solution is preferably 1 g/L to 30 g/L, and more preferably 2 g/L to 25 g/L. When the content of the nonionic surfactant or the ionic surfactant is less than the lower limit, there is a possibility that effect of preventing the precipitated compound contaminations derived from Sn or the Sn alloy from accumulating cannot be satisfactorily improved. When the content of the nonionic surfactant or the ionic surfactant is more than the upper limit, there is a possibility that a large amount of the nonionic surfactant or the ionic surfactant depositing on the members remains even after a subsequent washing step and causes adverse effects on subsequent steps.

The specific acidic solution used in the treatment method of the present invention can optionally contain various kinds of other additives such as a lubricating agent, an antiseptic agent, a defoaming agent, and an antifungal agent, in addition to the acid and/or the salt thereof, the complexing agent and/or the chelate agent, and the nonionic surfactant or the ionic surfactant.

A preparation method of the acidic solution is not particularly limited. For example, there can be adopted a method in which: the acid and/or the salt thereof is suitably selected, and the complexing agent and/or the chelate agent, the nonionic surfactant or the ionic surfactant, the various kinds of other additives and the like are optionally and suitably selected; the content of each component in the acidic solution is adjusted to, for example, the range mentioned above such that the pH of the acidic solution is within the range mentioned above: and these components are dissolved in distilled water or the like.

In the treatment method of the present invention, the members to be washed with the acidic solution are at least members used in a series of plating treatment steps with Sn or the Sn alloy, and are not particularly limited. For example, the members to be washed with the acidic solution are members on which the compound contaminations derived from Sn or the Sn alloy may precipitate and accumulate, such as: a substrate such as a wafer; a printed substrate; a conveyance tool for the substrates; a contact part of the substrates; and a nonconductive member for protecting the contact parts. In particular, the precipitated compound contaminations derived from Sn or the Sn alloy easily accumulate on the conveyance tool, and such accumulation cannot be prevented by conventional methods. However, the accumulation can be easily and effectively prevented by the treatment method of the present invention.

In the treatment method of the present invention, when the members are a substrate such as a wafer, a printed substrate and a conveyance tool for the substrates, the washing with the acidic solution is preferably performed in a state where each substrate is fixed to the conveyance tool. By performing the washing with the acidic solution in a state where the substrate is fixed to the conveyance tool as mentioned above, the compound contaminations derived from Sn or the Sn alloy, which have precipitated on both the conveyance tool and the substrate, can be simultaneously and easily removed. Therefore, for, in particular, the conveyance tool on which the precipitated compound contaminations derived from Sn or the Sn alloy easily accumulate, such accumulation can be effectively prevented.

A method of washing the members with the acidic solution is not particularly limited. For example, there can be adopted: a method of immersing the members in an acidic solution of about 20° C. to about 60° C. for about 0.5 minutes to about 3 minutes; a method of spraying the acidic solution onto the members; or a method of bringing the members into contact with the acidic solution by using a shower method.

In the treatment method of the present invention, the members are washed with the acidic solution immediately after the plating with Sn or the Sn alloy, and as mentioned above, after the washing with the acidic solution, the members may be washed with water or warm water and dried.

Conditions and a method of the washing with water or warm water are not particularly limited. For example, there can be adopted: a method of immersing the members in water of about 20° C. to about 35° C. or warm water of about 35° C. to about 60° C. for about 0.5 minutes to about 3 minutes; a method of spraying water or warm water onto the members as in the case of the washing with the acidic solution, or a method of bringing the members into contact with water or warm water by using a shower method as in the case of the washing with the acidic solution.

Conditions and a method of the drying are not particularly limited. For example, a method of drying the members at about 20° C. to about 150° C. with cold air, warm air, or compressed air can be adopted.

In the present invention, the series of plating treatment steps with Sn or the Sn alloy is not particularly limited, and steps of general plating treatment can be adopted. An Sn plating bath used in the plating may be a bath containing at least a soluble tin salt which is, for example, a tin salt of an organic sulfonic acid such as methanesulfonic acid, ethanesulfonic acid, 2-propanolsulfonic acid, sulfosuccinic acid, or p-phenolsulfonic acid, and optionally containing: an acid and a salt thereof; and various kinds of additives such as an antioxidizing agent, a stabilizing agent, a complexing agent, a surfactant, a brightener, a lubricating agent, a pH adjuster, a conductive salt, and an antiseptic agent. An Sn alloy plating bath used in the plating may be the Sn plating bath further containing soluble metal salts such as a soluble silver salt, a soluble copper salt, a soluble bismuth salt, and a soluble indium salt. The plating may be electroplating or electroless plating, and conditions for each plating are not particularly limited.

EXAMPLES

Examples for explaining the treatment method after the plating with Sn or the Sn alloy of the present invention in detail and comparative examples are shown below.

Reference Example

(1) Reference Example 1: Sn Plating

An Sn electroplating bath having the following composition was initially made. Plating conditions are also shown.

[Plating Bath Composition]
- Stannous methanesulfonate (as $Sn^{2+}$): 60 g/L
- Methanesulfonic acid (as free acid): 150 g/L
- 1-(2-Dimethylaminoethyl)-5-mercaptotetrazole: 2 g/L
- 3,6-Dithiaoctane-1,8-diol: 2 g/L
- Bisphenol A polyethoxylate (EO: 13 moles): 10 g/L
- Catechol: 5 g/L

[Plating Conditions]
- Bath temperature: 30° C.
- Cathode current density: 1.0 A/dm$^2$
- Plating time: about 1800 seconds

(2) Reference Example 2: Sn—Ag Alloy Plating

An Sn—Ag alloy electroplating bath having the following composition was initially made. Plating conditions are also shown.

[Plating Bath Composition]
- Stannous methanesulfonate (as $Sn^{2+}$): 60 g/L
- Silver methanesulfonate (as $Ag^{+}$): 0.8 g/L
- Methanesulfonic acid (as free acid): 150 g/L
- 1-(2-Dimethylaminoethyl)-5-mercaptotetrazole: 2 g/L
- 3,6-Dithiaoctane-1,8-diol: 2 g/L
- Bisphenol A polyethoxylate (EO: 13 moles): 10 g/L
- Catechol: 5 g/L

[Plating Conditions]
- Bath temperature: 30° C.
- Cathode current density: 1.0 A/dm$^2$
- Plating time: about 1800 seconds

Example and Comparative Example

(1) Example 1

An acidic solution having the following composition was prepared. Then, a series of the following step 1 to step 7 was repeated 30 times.

[Acidic Solution Composition]
- Methanesulfonic acid: 100 g/L
- pH: 1 or lower

[Steps]
- Step 1: Fixing a wafer onto a conveyance tool
- Step 2: Washing with water (room temperature of 20° C. to 30° C., immersion for 0.5 minutes)
- Step 3: Plating (Reference Example 1)
- Step 4: Washing with the acidic solution (25° C., immersion for 1 minute)
- Step 5: Washing with warm water (50° C., immersion for 0.5 minutes)
- Step 6: Drying (60° C., for 0.5 minutes)
- Step 7: Detaching the wafer from the conveyance tool

(2) Example 2

An acidic solution having the following composition was prepared. Then, a series of the following step 1 to step 7 was repeated 30 times.

[Acidic Solution Composition]
- Methanesulfonic acid: 100 g/L
- Gluconic acid: 5 g/L
- pH: 1 or lower

[Steps]
- Step 1: Fixing a wafer onto a conveyance tool
- Step 2: Washing with water (room temperature of 20° C. to 30° C., immersion for 0.5 minutes)
- Step 3: Plating (Reference Example 1)
- Step 4: Washing with the acidic solution (50° C., immersion for 1 minute)
- Step 5: Washing with warm water (50° C., immersion for 0.5 minutes)
- Step 6: Drying (60° C., for 0.5 minutes)
- Step 7: Detaching the wafer from the conveyance tool

(3) Example 3

An acidic solution having the following composition was prepared. Then, a series of the following step 1 to step 7 was repeated 30 times.

[Acidic Solution Composition]
- Methanesulfonic acid: 100 g/L
- Glycine: 10 g/L
- pH: 1 or lower

[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool (4) Example 4

An acidic solution having the following composition was prepared. Then, a series of the following step 1 to step 7 was repeated 30 times.
[Acidic Solution Composition]
Methanesulfonic acid: 100 g/L
Citric acid: 20 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool (5) Example 5

An acidic solution having the following composition was prepared. Then, a series of the following step 1 to step 7 was repeated 30 times.
[Acidic Solution Composition]
Methanesulfonic acid: 100 g/L
EDTA: 8 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool (6) Example 6

An acidic solution having the following composition was prepared. Then, a series of the following step 1 to step 7 was repeated 30 times.
[Acidic Solution Composition]
Methanesulfonic acid: 250 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7; Detaching the wafer from the conveyance tool (7) Example 7

An acidic solution having the following composition was prepared. Then, a series of the following step 1 to step 7 was repeated 30 times.
[Acidic Solution Composition]
Methanesulfonic acid: 500 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool (8) Example 8

An acidic solution having the following composition was prepared. Then, a series of the following step 1 to step 7 was repeated 30 times.
[Acidic Solution Composition]
Methanesulfonic acid: 100 g/L
Sodium gluconate: 10 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool (9) Example 9

An acidic solution having the following composition was prepared. Then, a series of the following step 1 to step 7 was repeated 30 times.
[Acidic Solution Composition]
Methanesulfonic acid: 100 g/L
Sodium malate: 10 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool

(10) Example 10

An acidic solution having the following composition was prepared. Then, a series of the following step 1 to step 7 was repeated 30 times.

[Acidic Solution Composition]
Methanesulfonic acid: 100 g/L
NTA: 10 g/L
pH: 1 or lower

[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool

(11) Example 11

An acidic solution having the following composition was prepared. Then, a series of the following step 1 to step 7 was repeated 30 times.

[Acidic Solution Composition]
Methanesulfonic acid: 100 g/L
pH: 1 or lower

[Steps]
Step 1: Fixing a wafer onto a conveyance tool
Step 2: Washing with water (room temperature of 20° C. to 30° C., immersion for 0.5 minutes)
Step 3: Plating (Reference Example 2)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool

(12) Example 12

An acidic solution having the following composition was prepared. Then, a series of the following step 1 to step 7 was repeated 30 times.

[Acidic Solution Composition]
Methanesulfonic acid: 600 g/L
Polyvinylpyrrolidone: 20 g/L
pH: 1 or lower

[Steps]
Step 1: Fixing a wafer onto a conveyance tool
Step 2: Washing with water (room temperature of 20° C. to 30° C., immersion for 0.5 minutes)
Step 3: Plating (Reference Example 2)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool

(13) Example 13

An acidic solution having the following composition was prepared. Then, a series of the following step 1 to step 7 was repeated 30 times.

[Acidic Solution Composition]
Methanesulfonic acid: 10 g/L
Polyethylene glycol (average molecular weight: 1000): 20 g/L
EDTA: 20 g/L
pH: 1 or lower

[Steps]
Step 1: Fixing a wafer onto a conveyance tool
Step 2: Washing with water (room temperature of 20° C. to 30° C., immersion for 0.5 minutes)
Step 3: Plating (Reference Example 2)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7; Detaching the wafer from the conveyance tool

(14) Example 14

An acidic solution having the following composition was prepared. Then, a series of the following step 1 to step 7 was repeated 30 times.

[Acidic Solution Composition]
Sulfuric acid: 100 g/L
pH: 1 or lower

[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool

(15) Example 15

An acidic solution having the following composition was prepared. Then, a series of the following step 1 to step 7 was repeated 30 times.

[Acidic Solution Composition]
Sulfuric acid: 100 g/L
EDTA: 20 g/L
pH: 1 or lower

[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool

(16) Example 16

An acidic solution having the following composition was prepared. Then, a series of the following step 1 to step 7 was repeated 30 times.

[Acidic Solution Composition]
Methanesulfonic acid: 100 g/L
Alkyl dimethylaminopropyl amide: 10 g/L
pH: 1 or lower

[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7; Detaching the wafer from the conveyance tool

(17) Example 17

An acidic solution having the following composition was prepared. Then, a series of the following step 1 to step 7 was repeated 30 times.
[Acidic Solution Composition]
Methanesulfonic acid: 100 g/L
Benzalkonium chloride: 5 g/L
Gluconic acid: 10 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool

(18) Example 18

An acidic solution having the following composition was prepared. Then, a series of the following step 1 to step 7 was repeated 30 times.
[Acidic Solution Composition]
Sodium methanesulfonate: 100 g/L
Methanesulfonic acid: 5 g/L
Gluconic acid: 10 g/L
pH: 3.5
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with the acidic solution (50° C., immersion for 1 minute)
Step 5: Washing with warm water (50° C., immersion for 0.5 minutes)
Step 6: Drying (60° C., for 0.5 minutes)
Step 7: Detaching the wafer from the conveyance tool

(19) Comparative Example 1

A series of the following step 1 to step 6 was repeated 30 times.
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with water (25° C. immersion for 1 minute)
Step 5: Drying (60° C., for 1 minute)
Step 6: Detaching the wafer from the conveyance tool

(20) Comparative Example 2

An acidic solution having the following composition was prepared. Then, a series of the following step 1 to step 8 was repeated 30 times.
[Acidic Solution Composition]
Methanesulfonic acid: 100 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with water (25° C., immersion for 0.5 minutes)
Step 5: Washing with the acidic solution (50° C., immersion for 1 minute)
Step 6: Washing with water (25° C., immersion for 0.5 minutes)
Step 7: Drying (60° C., for 0.5 minutes)
Step 8: Detaching the wafer from the conveyance tool

(21) Comparative Example 3

An acidic solution having the following composition was prepared. Then, a series of the following step 1 to step 9 was repeated 30 times.
[Acidic Solution Composition]
Methanesulfonic acid: 100 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 1)
Step 4: Washing with water (25° C. immersion for 0.5 minutes)
Step 5: Drying (60° C., for 0.5 minutes)
Step 6: Detaching the wafer from the conveyance tool
Step 7: Washing with the acidic solution (50° C., immersion for 1 minute)
Step 8: Washing with water (25° C., immersion for 0.5 minutes)
Step 9: Drying (60° C. for 0.5 minutes)

(22) Comparative Example 4

An acidic solution having the following composition was prepared. Then, a series of the following step 1 to step 8 was repeated 30 times.
[Acidic Solution Composition]
Methanesulfonic acid: 100 g/L
pH: 1 or lower
[Steps]
Step 1: Fixing a wafer onto a conveyance tool
Step 2: Washing with water (room temperature of 20° C. to 30° C., immersion for 0.5 minutes)
Step 3: Plating (Reference Example 2)
Step 4: Washing with water (25° C., immersion for 0.5 minutes)
Step 5: Washing with the acidic solution (50° C., immersion for 1 minute)
Step 6: Washing with water (25° C., immersion for 0.5 minutes)

Step 7: Drying (60° C., for 0.5 minutes)

Step 8: Detaching the wafer from the conveyance tool

Test Example

A surface of each conveyance tool after the steps in Examples 1 to 18 and Comparative Examples 1 to 4 was observed by using Field Emission Scanning Electron Microscope (FE-SEM, magnification of 50K, S-4800, commercially available from Hitachi High-Tech Corporation). After an area thus observed was divided into 4×5 squares, a surface coverage of the conveyance tool with the compound contaminations derived from Sn or the Sn alloy was obtained in accordance with the following equation, and prevention of accumulation of the compound contaminations was evaluated. The results are shown in Table 1.

Surface coverage (%)=(Number of squares to which contamination particles have adhered/Total number of squares)×100

TABLE 1

| | Surface coverage (%) |
|---|---|
| Example 1 | 30 |
| Example 2 | 0 |
| Example 3 | 0 |
| Example 4 | 10 |
| Example 5 | 15 |
| Example 6 | 30 |
| Example 7 | 30 |
| Example 8 | 5 |
| Example 9 | 5 |
| Example 10 | 15 |
| Example 11 | 30 |
| Example 12 | 5 |
| Example 13 | 5 |
| Example 14 | 30 |
| Example 15 | 5 |
| Example 16 | 0 |
| Example 17 | 0 |
| Example 18 | 30 |
| Comparative Example 1 | 100 |
| Comparative Example 2 | 100 |
| Comparative Example 3 | 100 |
| Comparative Example 4 | 100 |

As shown in Table 1, the wafer and the conveyance tool in each of Examples 1 to 18 were washed with the acidic solution containing the acid immediately after the plating with Sn or the Sn alloy in accordance with the treatment method of the present invention. In each of Examples 1 to 18, even after the plating and the washing with the acidic solution were repeated 30 times, the surface coverage of the conveyance tool with the compound contaminations derived from Sn or the Sn alloy was as low as 0% to 30%, and the compound contaminations were thus satisfactorily prevented from accumulating.

On the other hand, in Comparative Examples 1 to 4, the washing with the acidic solution was not performed (Comparative Example 1), or the washing with the acidic solution was performed not immediately after the plating with Sn or the Sn alloy but: immediately after the washing with water (Comparative Examples 2 and 4); or after the washing with water and the drying (Comparative Example 3). Therefore, the compound contaminations derived from Sn or the Sn alloy accumulated on the entire surface of each conveyance tool.

Like Example 1 in which the washing was performed with the acidic solution containing only the organic acid, also in each of Examples 2 to 5, 8 to 10 and 18 in which the washing was performed with the acidic solution containing the complexing agent and/or the chelate agent in addition to the organic acid, the surface coverage of the conveyance tool with the compound contaminations derived from Sn was as low as 0% to 30%, and the compound contaminations were thus satisfactorily prevented from accumulating.

As compared with Example 1 in which the washing was performed with the acidic solution containing only the organic acid, in each of: Example 16 in which the washing was performed with the acidic solution containing the surfactant in addition to the organic acid: and Example 17 in which the washing was performed with the acidic solution containing the complexing agent and the surfactant in addition to the organic acid, the surface coverage of the conveyance tool with the compound contaminations derived from Sn was 0%, and the compound contaminations were thus completely prevented from accumulating.

Also when the plating with the Sn—Ag alloy was performed as in Examples 11 to 13, by performing the washing with: the acidic solution containing only the organic acid (Example 11); the acidic solution containing the surfactant in addition to the organic acid (Example 12); or the acidic solution containing the complexing agent and the surfactant in addition to the organic acid (Example 13), immediately after the plating, the surface coverage of the conveyance tool with the compound contaminations derived from the Sn—Ag alloy was as low as 5% to 30%, and the compound contaminations were thus satisfactorily prevented from accumulating.

As in Examples 14 to 15, also when the washing was performed with: the acidic solution containing only the inorganic acid (Example 14); or the acidic solution containing the complexing agent in addition to the inorganic acid (Example 15), immediately after the plating, the surface coverage of the conveyance tool with the compound contaminations derived from Sn was as low as 5% to 30%, and the compound contaminations were thus satisfactorily prevented from accumulating.

INDUSTRIAL APPLICABILITY

The treatment method after plating with Sn or an Sn alloy of the present invention can easily and effectively prevent compound contaminations derived from Sn or the Sn alloy, which have precipitated on a substrate, a conveyance tool and the like, from accumulating. Therefore, the treatment method of the present invention can be suitably used in a series of plating treatment steps with Sn or the Sn alloy.

What is claimed is:

1. A treatment method after plating with Sn or an Sn alloy, comprising:

performing plating with Sn or an Sn alloy;

washing at least one of members used in a series of plating treatment steps with an acidic solution immediately after the plating with Sn or the Sn alloy, the acidic solution containing at least one kind selected from acids and salts thereof and having a pH of 5 or lower, wherein the acidic solution contains at least one complexing agent selected from the group consisting of gluconic acid, glycine, glucoheptonic acid, gluconolactone, glucoheptolactone, sorbic acid, and a salt thereof, the at least one of members is at least a conveyance tool for a substrate. repeating the plating and the washing 30 times, obtaining a surface coverage of the conveyance tool of 0% to 30%, wherein the surface coverage is a coverage of a surface of the conveyance tool with compound contaminations containing the Sn or the Sn alloy and is calculated by steps (i) to (iii):

(i) observing by Field Emission Scanning Electron Microscopy the surface of the conveyance tool after repeating the plating and the washing 30 times;

(ii) dividing an area of the surface into 4×5 squares such that a total number of squares is 20; and (iii) calculating the surface coverage according to equation (1):

$$\text{Surface coverage (\%)} = (\text{Number of squares having the compound contaminations}/\text{Total number of squares}) \times 100 \quad (1).$$

2. The treatment method according to claim 1, wherein the at least one of members further comprises a substrate, and the washing with the acidic solution is performed in a state where the substrate is fixed to the conveyance tool.

3. The treatment method according to claim 1, wherein the at least one kind selected from acids and salts thereof comprises at least one kind selected from organic acids and salts thereof.

4. The treatment method according to claim 1, wherein a content of the at least one kind selected from acids and salts thereof in the acidic solution is 8g/L to 700g/L.

5. The treatment method according to claim 1, wherein the acidic solution further contains at least one kind selected from nonionic surfactants or at least one kind selected from ionic surfactants.

6. The treatment method according to claim 1, wherein the plating with Sn or an Sn alloy is electroplating with Sn or an Sn alloy.

7. The treatment method according to claim 6, wherein the at least one of members further comprises a substrate.

* * * * *